US005243638A

United States Patent [19]

Wang et al.

[11] Patent Number: 5,243,638

[45] Date of Patent: Sep. 7, 1993

[54] APPARATUS AND METHOD FOR GENERATING A PLASMA X-RAY SOURCE

[76] Inventors: Hui Wang; Weimin Shi, both of 81 Lincoln Ave., Piscataway, N.J. 08854

[21] Appl. No.: 848,205

[22] Filed: Mar. 10, 1992

[51] Int. Cl.[5] ..... H01J 35/22

[52] U.S. Cl. ..... 378/119; 378/120; 378/143

[58] Field of Search ..... 378/119, 120, 121, 125, 378/126, 140, 143

[56] References Cited

U.S. PATENT DOCUMENTS

| | | |
|---|---|---|
| 4,368,538 | 1/1983 | McCorkle . |
| 4,379,977 | 4/1983 | Carmel et al. . |
| 4,570,106 | 2/1986 | Sohval et al. . |
| 4,596,030 | 6/1986 | Herziger et al. . |
| 4,627,088 | 12/1986 | Doucet et al. . |
| 4,635,282 | 1/1987 | Okada et al. . |
| 4,644,576 | 2/1987 | Kuyel . |
| 4,701,941 | 10/1987 | Szirmal et al. . |
| 4,715,054 | 12/1987 | Kato et al. . |
| 4,771,447 | 9/1988 | Saitoh et al. . |
| 4,947,415 | 8/1990 | Collins . |

FOREIGN PATENT DOCUMENTS

| | | | |
|---|---|---|---|
| 0188040 | 11/1983 | Japan | 378/119 |
| 0133644 | 7/1985 | Japan | 378/119 |
| 0088435 | 5/1986 | Japan | 375/119 |

*Primary Examiner*—David P. Porta

*Attorney, Agent, or Firm*—Spencer, Frank & Schneider

[57] ABSTRACT

A method and apparatus are provided for generating x-ray photon radiation. A liquid cone anode and an extraction electrode spaced therefrom are disposed in a vacuum chamber. The liquid cone anode comprises a liquid material, a reservoir for holding the liquid material having an opening for passage of the liquid material, and a liquid material feeding and cone forming mechanism operatively associated with the reservoir for feeding liquid material through the opening in the reservoir and for forming a liquid cone from the liquid material A power supply is connected to the liquid cone anode and the extraction electrode for creating an electric field therebetween of sufficient strength to cause particles to be extracted from the liquid cone anode to form a plasma ball in the space between the liquid cone anode and the extraction electrode which emits x-ray photon radiation.

28 Claims, 8 Drawing Sheets

APPARATUS AND METHOD FOR GENERATING A PLASMA X-RAY SOURCE

BACKGROUND OF THE INVENTION

1. Field of the Invention

This invention relates to a method and apparatus for generating x-ray photon radiation and, more particularly, for generating x-ray photon radiation from a plasma source.

2. Description of the Related Art

Photons are emitted when electrons return from a higher energy orbit to a lower one. A high brightness (intensity) photon source can be produced if the lower orbit electrons can be excited to a higher energy orbit at high efficiency. One way to do this is to use high temperature and high density plasma.

Several plasma x-ray sources have been previously developed. These plasma sources can be divided into non-laser plasma sources and laser plasma sources. The problems associated with non-laser plasma x-ray sources are (1) a very large source spot, such as in a gas puff z-pinch x-ray source, which limits resolution in an imaging application; or, (2) a short life time, such as in a vacuum spark x-ray source, where the source anode, bombarded by negatively charged particles, is subjected to extremely high temperatures which may evaporate the anode after a few hundred flashes.

Problems associated with a laser plasma x-ray source include massive structure and high cost. In addition, the laser plasma x-ray source is less versatile in that it produces only soft x-rays which have relatively low energy in a range from about 0.25–10 keV. Soft x-rays cannot meet the requirements of some applications, for example, in non-destructive evaluation of materials and machined structures where a large penetration depth of x-ray is needed.

SUMMARY OF THE INVENTION

It is an object of the invention to provide a method and apparatus for producing a non-laser plasma type micro-spot size x-ray radiation source.

It is an additional object of the invention to provide a non-laser plasma type x-ray source having a longer life time.

It is a further object of the invention to provide an x-ray source having an adjustable wavelength and high brightness capability.

It is a still further object of the invention to provide a non-laser type source having an inexpensive and portable structure.

The above and other objects of the invention are accomplished by the provision of a device for generating x-ray photon radiation, comprising: a vacuum chamber; a liquid cone anode disposed in the vacuum chamber and including a liquid material, a reservoir for holding the liquid material, the reservoir having an opening for passage of the liquid material, and liquid material feeding and cone forming means operatively associated with the reservoir for feeding liquid material through the opening in the reservoir and for forming a liquid cone from the liquid material; an extraction electrode disposed in the vacuum chamber opposite the liquid cone anode; and power supply means connected to the liquid cone anode and the extraction electrode for creating an electric field between the liquid cone anode and the extraction electrode of sufficient strength to cause particles to be extracted from the liquid cone to form a plasma ball in the space between the liquid cone anode and the extraction electrode which emits x-ray photon radiation.

In a further aspect of the invention there is provided a method for generating x-ray photon radiation, comprising: forming a cone of liquid material at an anode electrode; and generating an electric field between the anode electrode and an extraction electrode spaced apart from the anode electrode of sufficient strength to cause particles to be extracted from the liquid cone to form a plasma ball in a space between the anode electrode and the extraction electrode which emits x-ray photon radiation.

Compared with conventional x-ray sources, the x-ray source produced in accordance with the method and apparatus of the invention has a number of advantages, including: 1) the x-ray source anode is self-replenishing and self-healing; (2) the plasma ball source spot volume is exceptionally small, having a diameter in the range between sub-micrometer to tens of micrometers; and (3) the current density of the negative particles is not limited by a fear of melting through the anode.

The above and other advantages and features of the invention allow the inventive x-ray source to be used in many applications, such as x-ray lithography for the fabrication of semiconductor integrated circuits; radiography for the nondestructive testing of machined parts and aging structures; x-ray microscopy for the imaging of living specimens; x-ray holography for 3-D imaging; high resolution fluoroscopy for medical diagnosis; and possible large power x-ray laser.

The invention will be better understood in greater detail with reference to several specific embodiments thereof that are illustrated in the drawings.

DETAILED DESCRIPTION OF PREFERRED EMBODIMENTS

Figure 1:
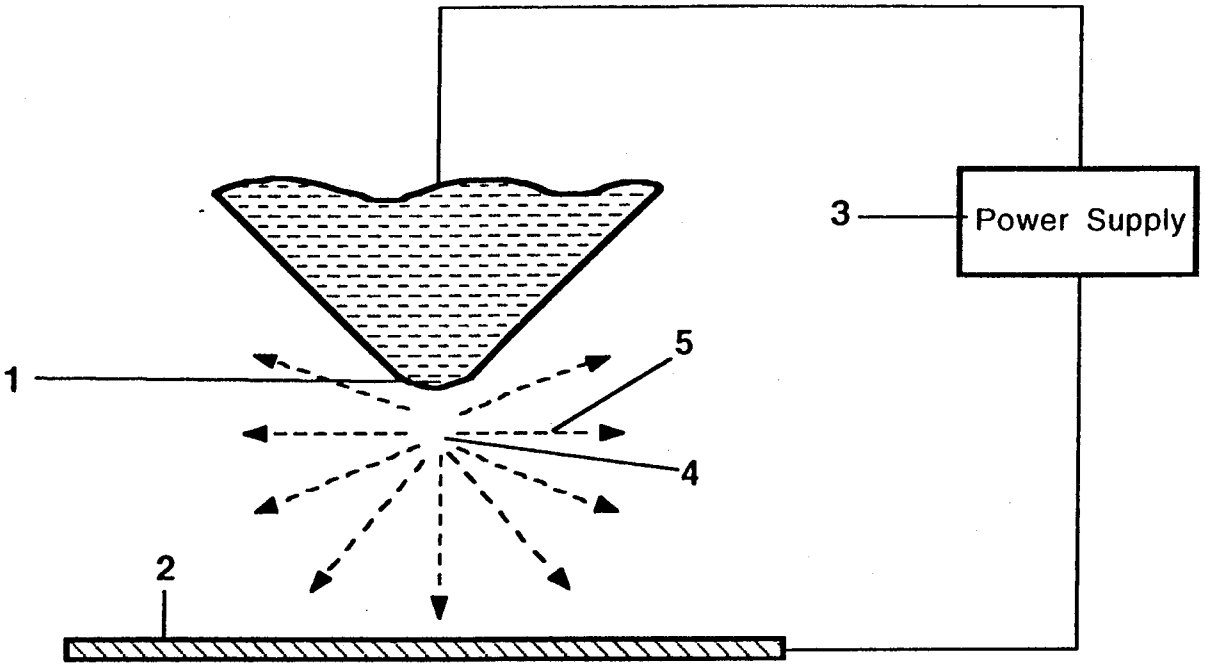
FIG. 1 is a generalized schematic view of a device for generating x-ray radiation in accordance with the present invention.

In describing the various embodiments of the invention, corresponding parts in different figures are designated with the same reference numerals in order to minimize repetitive descriptions.

FIG. 1 is a schematic illustrating the principles of the invention for establishing a plasma x-ray radiation source. A liquid cone 1 of liquid cone anode, described in detail below, is shown electrically connected to a planar extraction electrode 2 via a power supply 3. The axis of liquid cone 1 is normal to the plane of planar electrode 2. When a sufficient electrical voltage (e.g. 1 KV to 100 KV) is applied between liquid cone 1 and planar electrode 2, positively charged particles, i.e. ions and ionized clusters, and neutral particles, i.e. atoms and clusters, are extracted from the liquid cone by filed evaporation. These particles will generate a high density, high temperature, and small size plasma ball 4 near liquid cone 1 from which omni-directional high brightness x-rays 5 are emitted.

Figure 2:
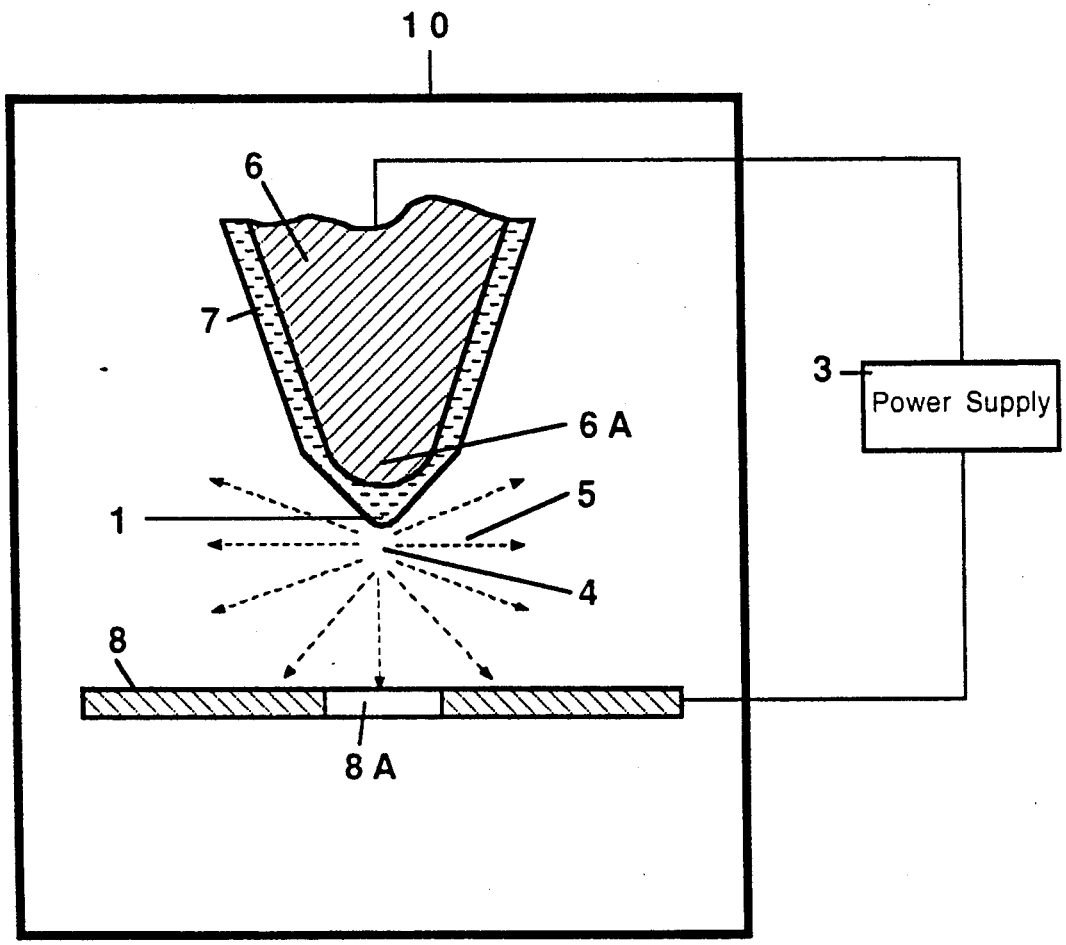
FIG. 2 is a generalized schematic cross-sectional view of one embodiment of the present invention.

FIG. 2 is a schematic depiction of a device for implementing the invention. A vacuum chamber 10 houses the x-ray generating apparatus. Preferably, the vacuum pressure is maintained in a range lower than $10^{-5}$ Torr. A liquid cone anode, described in detail in connection with FIGS. 3A–3D, includes a reservoir (not shown in FIG. 2) for supplying a liquid material 7 for covering end 6A of liquid material feeding structure 6 (partially shown in FIG. 2) for formation of liquid cone 1. Useful materials in a liquid stage include a variety of metals, metal alloys, semiconductors and insulators, for example: Lithium, Sodium, Aluminum, Potassium, Gallium, Germanium, Palladium, Indium, Tin, Caesium, Gold, Mercury, Lead, Bismut, $GA_{75.5}$-$In_{24.5}$, $Ga_{62}$-$In_{25}$-$Sn_{13}$, $Pt_{72}$-$B_{28}$, $Pd_{40}$-$Ni_{40}$-$B_{20}$, $B_{60}$-$Ni_{13}$-$Pt_{27}$, $Pd_{40}$-$Ni_{40}$-$B_{10}$-$As_{10}$, $Pt_{72}$-$As_{28}$, $Sb_{50}$-$Pb_{42}$-$Au_8$, $Au_{69}$-$Si_{31}$, $Au_{82}$-$Ge_{18}$, $Au_{80}$-$Be_{20}$, Sodium hydroxide, Potassium hydroxide, Lithium nitrate, and Sodium nitrate. These materials in a liquid state readily form ions in the presence of a sufficient high electrical field. Preferably, useful materials for forming the liquid cone have a relatively low vapor pressure at their melting point or around the operating temperature, for example, $10^{-4}$ Torr. The liquid material feeding structure 6 has a melting temperature higher than that of liquid material 7 and is substantially unreactive with the liquid material. Materials suitable for making liquid material feeding structure 6 include: preferably Tungsten, Tantalum, Molybdenum, Nickel, Titanium, Platinum, Titanium carbine, Nichrome, Zirconium carbide, Boron nitride, Titanium boride, Chromium boride, Zirconium boride, and BN-$TiB_2$ composite. Desirably, the liquid material feeding structure 6 has an end 6A with an apex radius in the range from 0.1 um to 100 um.

An extraction electrode 8, made of a metal or alloy conductor, preferably Tantalum because of its low sputtering rate, is space apart from liquid cone 1 therebelow. The extraction electrode 8 is preferably circular and has a window 8A at its center. Window 8A is centered about the axis of liquid cone anode 1 and is made of a suitable material transmissive in the x-ray range. The preferred shape of the window 8A is round with a diameter in the range from 0.1 mm to 10 mm. Liquid material feeding structure 6 is set perpendicular to the surface of the extraction electrode 8. The preferred distance between the tip of liquid material feeding structure 6 and the extraction electrode 8 is in the range from 0.5 mm to 50 mm. When a sufficient electrical voltage is applied between the liquid material feeding structure 6 and the extraction electrode 8, liquid material 7 forms liquid cone 1 in balancing between electrostatic and surface tension forces.

Power supply 3 provides a sufficiently high continuous or intermittent voltage output in the following ranges. The amplitude of the continuous voltage output of the power supply 3 should be substantially adjustable in the range from 1 kV to 100 kV; and, the intermittent voltage output of the power supply 3 should substantially range from 0 V to 100 kV with a frequency range from 0 Hz to 100 Hz, and a pulse width between 0 to 100% of the period of the output pulse. The output current of the power supply 3 should be substantially adjustable in the range from 0 mA to 1,000 mA in the continuous wave mode and rom 0 A to 1,000 kA in the pulse mode. The resulting electric field strength on the liquid cone should be in excess of $10^9$ volts/meter. A variety of power supplies meeting the foregoing requirements are commercially available.

One terminal of the power supply 3 is connected to liquid material feeding structure 6 and the other terminal is connected to extraction electrode 8. Plasma ball 4 and emitted x-ray radiation 5 are as shown in FIG. 1. The omnidirectional x-rays 5 emitted can be conveniently outputted through window 8A of the extraction electrode 8 or in a direction normal to the axis of the liquid material feeding structure 6.

The x-ray output intensity, size of the plasma ball 4, and spectrum of x-rays can be adjusted by varying the operating conditions. For example, an increase in the discharge current between the liquid cone anode and extraction electrode 8 provides increased intensity and density of x-ray emission. Also, the diameter of plasma ball 4 can be adjusted by varying the pulse width of an intermittent output voltage of power supply 3 and the discharge current. In a pulse voltage output mode, the highest frequency of the intermittent voltage is mainly determined by the recovery time for the shape of the liquid material cone after a discharge. In general, the recovery time is about 10 milliseconds, so that the frequency of the intermittent voltage should be set lower than 100 Hz. In the pulse mode, a high intensity plasma may be generated intermittently. The discharge current may range from 1 A to 1000 A. While in a continuous wave mode, a smaller intensity plasma is generated. The discharge current may range from 1 mA to 1 A. The size of the plasma ball 4 is smaller than the apex radius of liquid material feeding structure 6 and larger than herein described of liquid cone 1. In general, plasma ball 4 has a diameter between sub micrometer to tens of micrometers. In addition, the spectrum of the x-ray emission is determined by the species of liquid material 7, the discharge voltage, and discharge current.

Figure 3A:
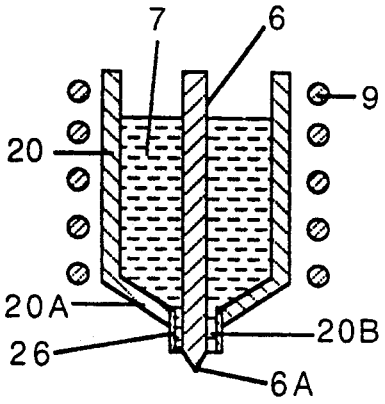
FIGS. 3A–3D are schematic cross-sectional views four different embodiments for forming a liquid cone anode in accordance with the present invention.

FIG. 3A illustrates one embodiment of a liquid cone anode in accordance with the present invention. A supply of liquid material 7 is store in a cylindrically shaped reservoir 20 having a lower funnel shaped end 20A terminating in a cylindrical neck 26 having an inner diameter 20B which is larger than the diameter of needle shaped, liquid material feeding structure 6 disposed in reservoir 20 and projecting through neck 26.

Reservoir 20 is made of a material, preferably Tungsten, having a higher melting temperature than that of liquid material 7. Liquid material 7 may be of the aforementioned type. The liquid material feeding structure 6 is a solid needle having a tapered and rounded tip at its lower end 6A. Preferably, the rounded tip of liquid material feeding structure 6 has an apex radius in the range of 0.1 um to 100 um. The liquid material feeding structure 6 is preferably made of the materials already described above in connection with FIG. 2. The material of liquid material feeding structure 6 has a higher melting temperature than that of liquid material 7 and which will not substantially react with, but can be wetted by liquid material 7.

A heating filament 9 is provided adjacent to reservoir 20 such that a material of the specified type in solid phase during normal operation temperature of the x-ray source may be placed in reservoir 20 and liquefied by the heating filament.

Figure 3B:
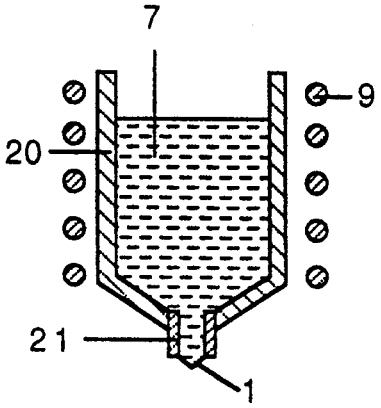
Figure 3C:
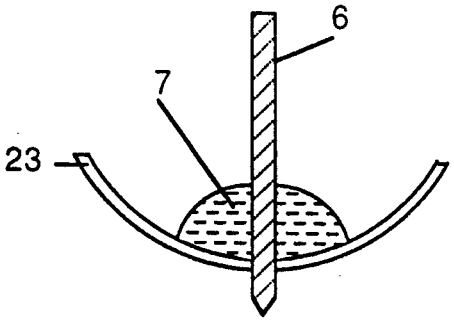

FIG. 3B is an alternative embodiment of a liquid cone anode in accordance with the present invention. The embodiment of FIG. 3B is similar to that of FIG. 3A except that a capillary tubing 21 is used as the liquid material feeding structure to supply liquid material for formation of liquid cone 1 of liquid cone anode. Capillary tubing 21 comprises a material, preferably Tungsten, having a higher melting temperature than that of the liquid material 7. Tubing 21 does not react with but is wetted by liquid material 7. The inside diameter of the capillary tubing 21 is in the range from 0.1 um to 1,000 um.

Figure 3D:
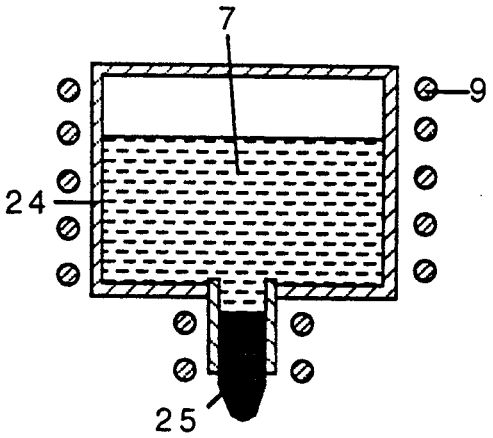

FIG. 3D shows a further alternative embodiment for forming a liquid cone anode in accordance with the present invention. A ribbon 23 is used for holding and/or heating liquid material 7. Ribbon 23 has an opening (not shown) having a diameter sufficient to allow liquid material 7 to form a liquid cone at the tip of needle shaped, liquid material feeding structure 6 in the presence of a sufficiently strong electric field. Ribbon 23 comprises a material, preferably Tungsten, having a higher melting temperature than that liquid material 7 and is substantially nonreactive with the liquid material.

FIG. 3D illustrates yet another alternative embodiment for forming a liquid cone anode in accordance with the present invention. A chamber housing 24 has an opening at its bottom in which is placed a liquid material feeding structure 25 which comprises a molded sintered metal or alloy of selected from the materials listed above for liquid material feeding structure 6. The liquid material feeding structure 25 has a higher melting temperature than that of the liquid material 7, and has a porosity capable of feeding the liquid material through its body. Chamber 24 comprises a material, preferably Tungsten, having a higher melting temperature than that of the liquid material 7 and is substantially nonreactive with the liquid material.

Figure 4:
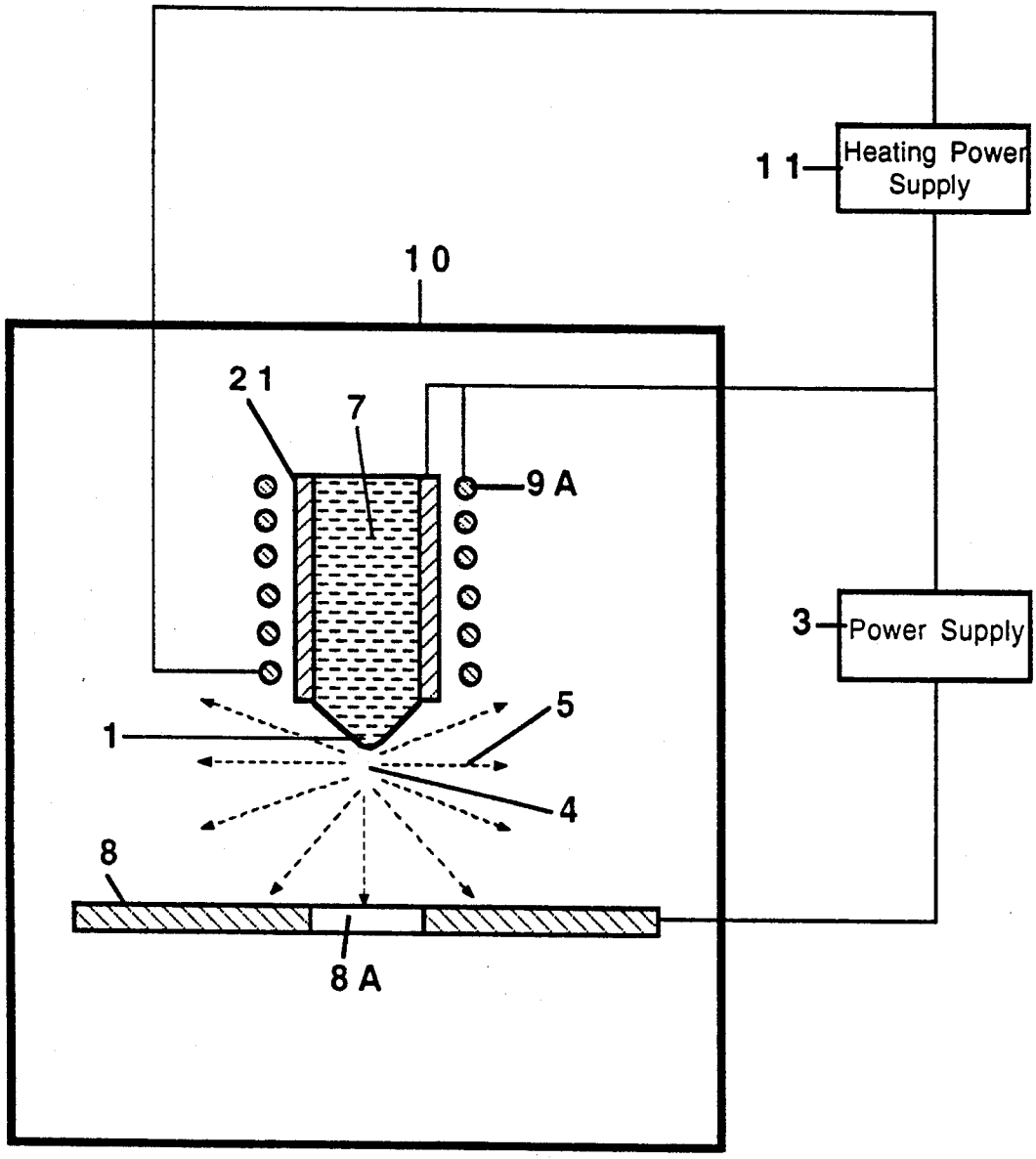
FIGS. 4–8 are schematic cross-sectional views of alternative embodiments of a device for creating an x-ray radiation source in accordance with the present invention.

FIG. 4 is another embodiment of the x-ray radiation source in accordance with the present invention. The embodiment of FIG. 4 is similar to that of FIG. 2 except that the liquid material feeding structure corresponds to that shown in FIG. 3B with the additional feature that a heating element 9A is placed adjacent to capillary tubing 21. A heat power supply 11 supplies power to heating filament 9A.

Figure 5:
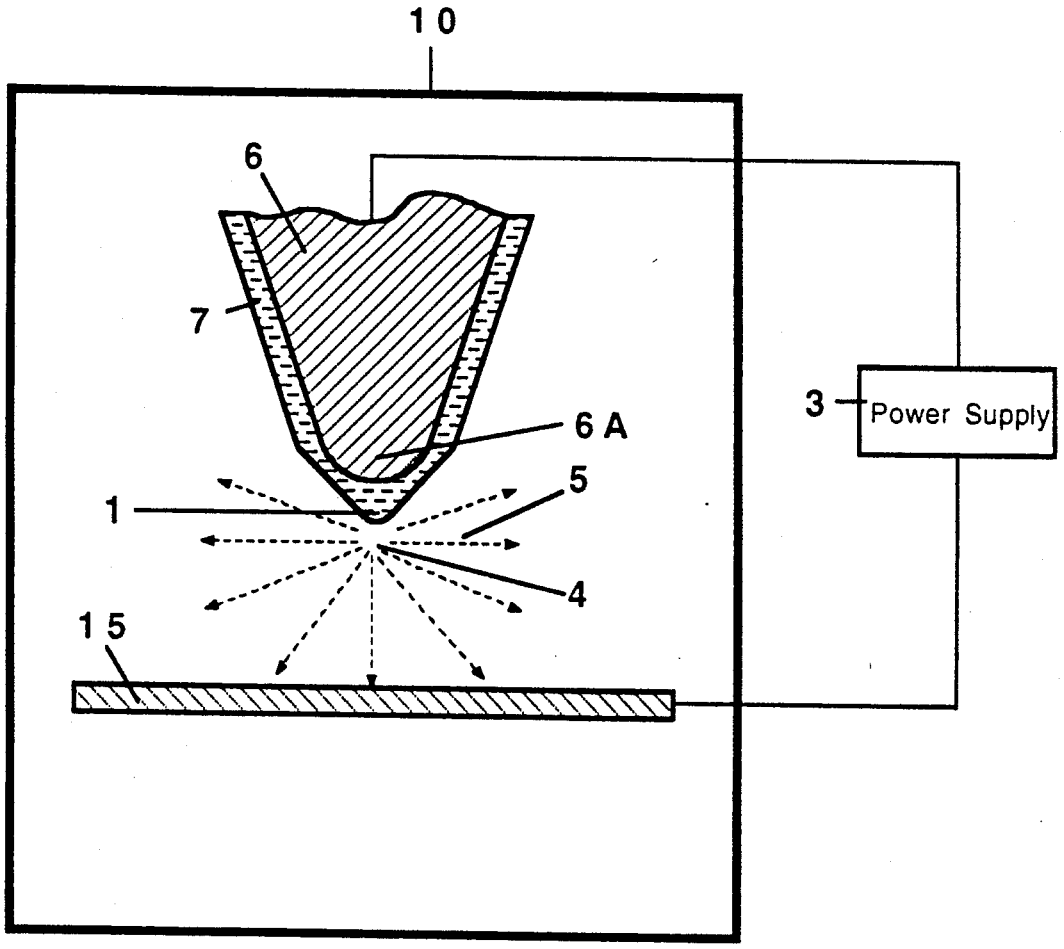

FIG. 5 is an additional embodiment of the x-ray radiation source in accordance with the invention. A windowless extraction electrode 15 comprises a conductive material, preferably, Tantalum. The distance between liquid cone 1 and the electrode 15 is in the range from 0.5 mm to 50 mm. Within this distance, the positively charged particles upon the surface of liquid cone 1 of the liquid anode may reach the surface of extraction electrode 15 under the influence of the electric field. The bombardment of the positively charged particles on the surface of extraction electrode 15 will cause secondary electron emission. These electrons will be accelerated, focused, and injected into the space about the liquid cone 1. These electrons will enhance the formation and increase the electron density of plasma ball 4. High brightness x-ray radiation 5 will emit from plasma ball 4 which can be output in the direction normal to the axis of the liquid material feeding structure 6.

Figure 6:
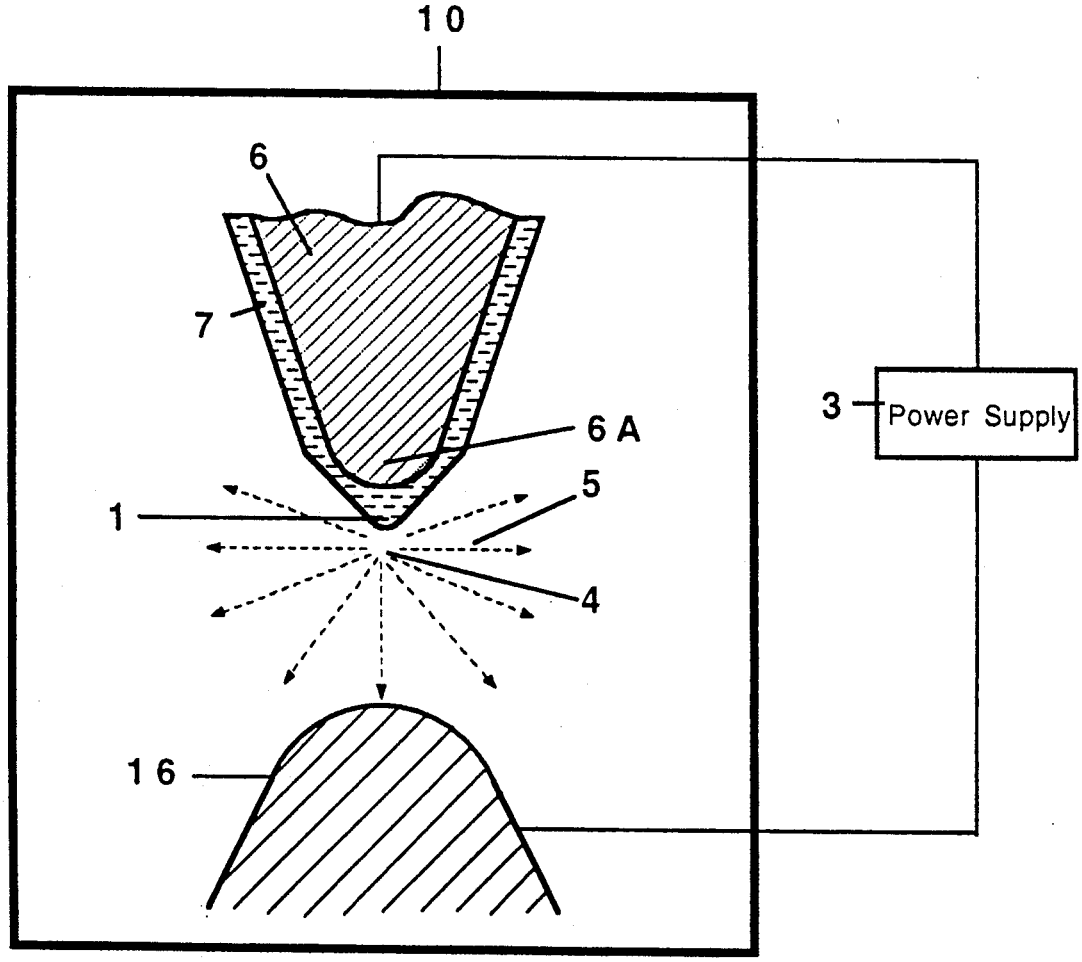

FIG. 6 is a further embodiment of the x-ray radiation source in accordance with the invention. Here, a cone-shaped extraction electrode 16 is provided with an apex radius in the range from 0.1 um to infinity. Extraction electrode 16 comprises a conductive material, preferably, Tantalum. Liquid cone 1 and cone-shaped extraction electrode 16 are set in axial alignment. The distance between the liquid cone and the apex of the electrode 16 is in the range from 1 mm to 50 mm. The use of cone-shaped extraction electrode 16 increases the electrical field density in the area around liquid cone 1, and enhances the emitting and focusing of secondary electrons caused by bombardment of the positively charged particles on the surface of extraction electrode 16, thus increasing the density and further decreasing the size of plasma ball 4. During operation, the X-ray emission may be output in the direction normal to the axis of the liquid cone.

Figure 7:
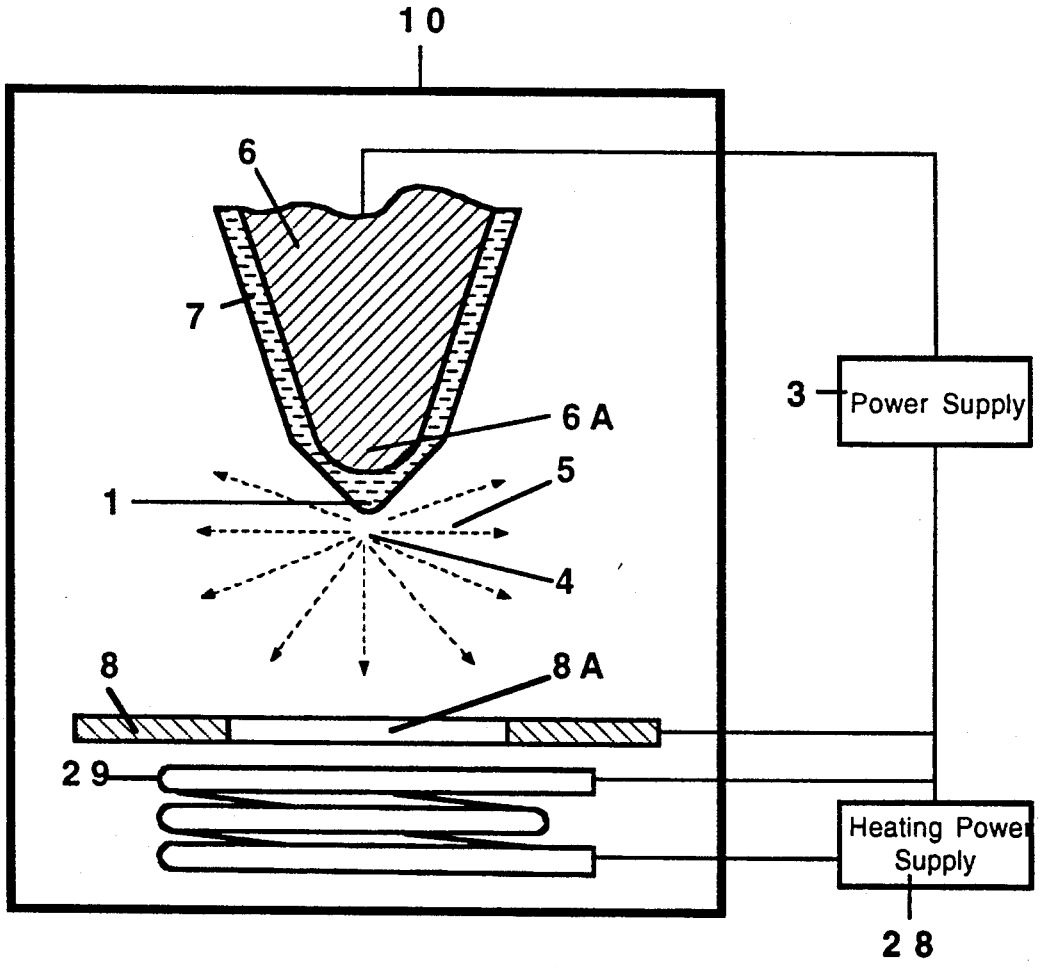

FIG. 7 is a still further embodiment of the x-ray radiation source in accordance with the invention. The embodiment of FIG. 7 is similar to that of illustrated in FIG. 2 with the addition of a coiled thermionic filament 29 which is employed to generate electrons. The filament 29 comprises a metal, preferably Tungsten, or an alloy having a high melting temperature and high thermionic electron emission efficiency. If filament 29 is made of Tungsten, its melting point is 3387 degrees centigrade. The temperature of filament 29 during operation is in the range between 2100 degrees centigrade to 2300 degrees centigrade with an emission current density between 100 to 400 mA/cm$^2$. The thermionic electron emission efficiency is about 4 to 14 mA/watt. Filament 29 is positioned in axial alignment with liquid material feeding structure 6 of the liquid cone anode. The distance between filament 29 and the extraction electrode window 8A is set about 5 mm. Placing filament 29 on a side of the extraction electrode opposite liquid cone anode helps prevent reaction between the liquid material 7 and the filament which might form an alloy or a compound on the surface of filament 29. The formation of an alloy or a compound on the surface of filament 29 will significantly reduce the life time of filament 29. A heat power supply 28 electrically connected to heating filament 29 supplies the requisite power. Electrons emitted from filament 29 are accelerated and focused into the space around the liquid cone 1 through extraction electrode window 8A. These electrons enhance the formation and increase the density of plasma ball 4.

Figure 8:
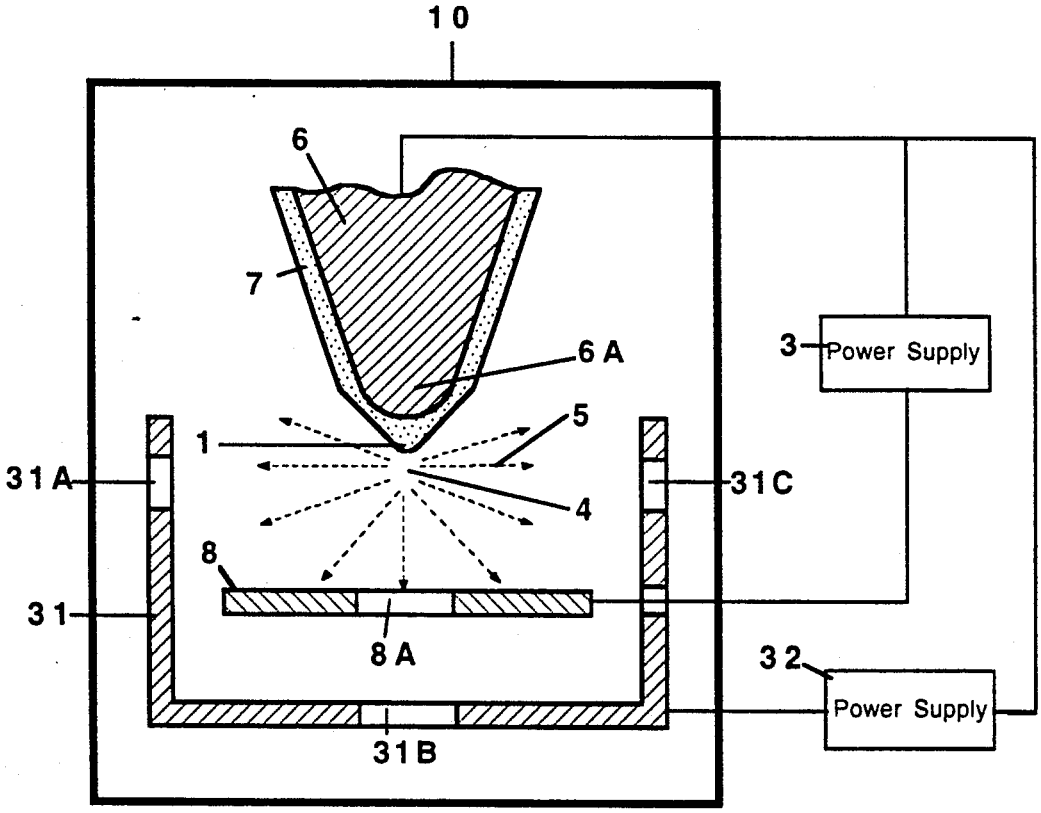

FIG. 8 is a yet further embodiment of the x-ray radiation source in accordance with the invention. In this embodiment, a shielding electrode 31 is employed to reflect ions and ionized clusters to prevent the x-ray source chamber from being contaminated. A power supply 32 supplies a bias voltage to shielding electrode 31 to help in preventing deposition of charged particles upon a set of x-ray output windows in the wall of vacuum chamber 10 (not shown) which are adjacent to windows 33A–33C in the shielding electrode 31, respectively. By way of exemplary parameters, the diameter of windows 33A–33C may be about 5 mm; the thickness of the shielding electrode may be 5 mm; the distance between extraction electrode 8 and shielding electrode 31 may be about 10 mm; and the shielding bias voltage may be about 5 KV.

The inventors herein conducted an experiment of a prototype x-ray source constructed in accordance with the principles of the invention. The prototype was constructed in accordance with the embodiment of FIG. 2, utilizing a liquid cone anode of the type illustrated in FIG. 3A. The needle shaped liquid feeding structure 6 was made of Tungsten and reservoir 20 contained liquid Gallium 7, having a vapor pressure of $10^{-8}$ Torr. The vacuum pressure in chamber 10 was set at about $10^{-5}$ Torr. Liquid material feeding structure 6 had an apex radius of about 10 micrometers. The circular extraction electrode 8 was made of Tantalum. At the center of extraction electrode 8 round window 8A had a diameter of about 5 mm. The distance between the tip of liquid material feeding structure 6 and extraction electrode 8 was set at about 10 mm.

In a continuous x-ray out mode of the above described prototype, power supply 3 was set to produce a continuous output voltage of 25 KV and an output current of 2 mA. A plasma ball was produced that generated about 120 mW of continuous x-ray output as measured with a standard x-ray detector.

In an intermittent x-ray output mode of the above described prototype, power supply 3 was employed to generate an intermittent voltage of 15 kV and current of 100 KA. The discharge interval was about 3 microseconds and the discharge frequency was about 40 Hz. A pulse mode x-ray output of about $1.5\times10^5$ W was measured using a standard x-ray detector.

While there have been described what are presently believed to be the preferred embodiments of the invention, it will be apparent to one skilled in the art that numerous changes can be made in the structure, ingredients, proportions and conditions set forth in the foregoing embodiments without departing from the invention as described herein and as defined in the appended claims.

What is claimed is:

1. A device for generating continuous x-ray photon radiation, comprising:

a vacuum chamber;

a liquid cone anode disposed in said vacuum chamber and including a liquid material, a reservoir for holding said liquid material, said reservoir having an opening for passage of the liquid material, and liquid material feeding and cone forming means operatively associated with said reservoir for feeding liquid material through the opening in said reservoir and for forming a liquid cone from the liquid material;

an extraction electrode disposed in said vacuum chamber opposite said liquid cone anode; and power supply means connected to said liquid cone anode and said extraction electrode for creating a continuous electric field between said liquid cone anode and said extraction electrode of sufficient strength to cause particles to be extracted from the liquid cone to form a plasma ball in the space between said liquid cone anode and said extraction electrode which emits continuous x-ray photon radiation.

2. A device as defined in claim 1, wherein said liquid feeding and cone forming means comprises a capillary tube connected to said reservoir for communicating with said opening, said capillary tube being made of material having a higher melting point than that of said liquid material.

3. A device as defined in claim 2, and further comprising heating means operatively associated with said capillary tube for heating said capillary tube.

4. A device as defined in claim 1, wherein said liquid feeding and cone forming means comprises an element having a rounded tip, being made of a porous, sintered metal or metal alloy and communicating with the liquid material by way of the opening in said reservoir, the liquid material passing through said element and forming a liquid cone on said rounded tip.

5. A device as defined in claim 1, and further comprising heating means operatively associated with said reservoir for heating said reservoir.

6. A device as defined in claim 1, wherein said liquid feeding and cone forming means comprises a solid needle disposed in said reservoir and projecting through said opening, said solid needle being made of material having a higher melting point than that of said liquid material.

7. A device as defined in claim 1, wherein said reservoir comprises a material having a melting point higher than that of said liquid material.

8. A device as defined in claim 1, wherein said liquid material comprises one of a metal, metal alloy, semiconductor material and electrically insulating material.

9. A device as defined in claim 1, wherein the particles extracted from said liquid cone include charged particles and said liquid cone anode and said extraction electrode are separated by a distance such that the charged particles extracted from said liquid cone bombard a surface of said extraction electrode to generate electrons which are injected into the plasma.

10. A device as defined in claim 1, wherein said extraction electrode includes a window through which x-ray photon radiation emitted from the plasma is allowed to pass.

11. A device as defined in claim 1, wherein said extraction electrode comprises one of a metal and metal alloy.

12. A device as defined in claim 1, wherein said extraction electrode is planar.

13. A device as defined in claim 1, wherein said extraction electrode is shaped in the form of a cone.

14. A device as defined in claim 1, wherein said vacuum chamber includes a wall having a window through which x-ray photon radiation from the plasma is allowed to pass.

15. A device as defined in claim 1, wherein said power supply means includes means for controlling voltage and current amplitudes.

16. A device as defined in claim 1, and further comprising electron generating means disposed for generating and injecting electrons into a space around the liquid cone.

17. A device as defined in claim 16, wherein said extraction electrode includes a window through which x-ray photon radiation from the plasma and electrons from said electron generating means are allowed to pass.

18. A device as defined in claim 1, and further comprising a shielding electrode at least partially surrounding a space to be occupied by the plasma and for preventing ions and ionized clusters from contaminating said vacuum chamber.

19. A device as defined in claim 18, and further comprising a voltage source connected to said shielding electrode to provide said shielding electrode with a shielding voltage.

20. A device as defined in claim 18, wherein said shielding electrode includes a window through which x-ray photon radiation from the plasma is allowed to pass.

21.. A method for generating continuous x-ray photon radiation, comprising:

forming a layer of liquid material over an anode electrode; and generating a continuous electrical field between the anode electrode and an extraction electrode spaced apart from the anode electrode of sufficient strength to form a cone of the liquid material at the anode electrode and to cause particles to be extracted from the liquid cone to form a plasma ball in a space between the anode electrode and the extraction electrode which emits continuous x-ray photon radiation.

22. A method as defined in claim 21, wherein said forming step includes creating a reservoir of the liquid material and feeding the liquid material from the reservoir to form the liquid cone.

23. A device for generating x-ray photon radiation, comprising:

a vacuum chamber;

a liquid cone anode disposed in said vacuum chamber and including a liquid material, a reservoir for holding said liquid material, said reservoir having an opening for passage of the liquid material, and liquid material feeding and cone forming means operatively associated with said reservoir for feeding liquid material through the opening in said reservoir and for forming a liquid cone from the liquid material;

said liquid feeding and cone forming means comprising an element having a rounded tip, being made of a porous, sintered metal or metal alloy and communicating with the liquid material by way of the opening in said reservoir, the liquid material passing through said element and forming a liquid cone on said rounded tip;

an extraction electrode disposed in said vacuum chamber opposite said liquid cone anode; and power supply means connected to said liquid cone anode and said extraction electrode for creating an electric field between said liquid cone anode and said extraction of sufficient strength to cause particles to be extracted from the liquid cone to form a plasma ball in the space between said liquid cone anode and said extraction electrode which emits x-ray photon radiation.

24. A device as defined in claim 23, and further including means for heating said element.

25. A device for generating x-ray photon radiation, comprising:

a vacuum chamber;

a liquid cone anode disposed in said vacuum chamber and including a liquid material, a reservoir for holding said liquid material, said reservoir having an opening for passage of the liquid material, and liquid material feeding and cone forming means operatively associated with said reservoir for feeding liquid material through the opening in said reservoir and for forming a liquid cone from the liquid material;

said liquid feeding and cone forming means comprises a solid needle disposed in said reservoir and projecting through said opening, said solid needle being made of material having a higher melting point than that of said liquid material said liquid feeding and cone forming means comprising an element having a rounded tip, being made of a porous, sintered metal or metal alloy and communicating with the liquid material by way of the opening in said reservoir, the liquid material passing through said element and forming a liquid cone on said rounded tip;

an extraction electrode disposed in said vacuum chamber opposite said liquid cone anode; ad power supply means connected to said liquid cone anode and said extraction electrode for creating an electric field between said liquid cone anode and said extraction of sufficient strength to cause particles to be extracted from the liquid cone to form a plasma ball in the space between said liquid cone anode and said extraction electrode which emits x-ray photon radiation.

26. A device for generating x-ray photon radiation, comprising:

a vacuum chamber;

a liquid cone anode disposed in said vacuum chamber and including a liquid material, a reservoir for holding said liquid material, said reservoir having an opening for passage of the liquid material, and liquid material feeding and cone forming means operatively associated with said reservoir for feeding liquid material through the opening in said reservoir and for forming a liquid cone from the liquid material;

an extraction electrode disposed in said vacuum chamber opposite said liquid cone anode;

an electron generating filament located on a side of said extraction electrode which is remote from said liquid cone anode for generating and injecting electrons into a space around the liquid cone; and power supply means connected to said liquid cone anode and said extraction electrode for creating an electric field between said liquid cone anode and said extraction of sufficient strength to cause particles to be extracted from the liquid cone to form a plasma ball in the space between said liquid cone anode and said extraction electrode which emits x-ray photon radiation.

27. A device as defined in claim 26, wherein said electron generating means further includes an electrical power supply connected to said filament for heating said filament.

28. A device as defined in claim 26, wherein said filament comprises a material having a high thermionic electron emission efficiency.

* * * * *

UNITED STATES PATENT AND TRADEMARK OFFICE

CERTIFICATE OF CORRECTION

PATENT NO. : 5,243,638

DATED : Sep. 7, 1993

INVENTOR(S) : Hui Wang

It is certified that error appears in the above-indentified patent and that said Letters Patent is hereby corrected as shown below:

On title page,

Item [76]: Change "Inventor" to read --Hui Wang, 2 Gilman Drive, Piscataway, New Jersey 08854--

Signed and Sealed this

Third Day of May, 1994

Bruce Lehman

*Attest:*

BRUCE LEHMAN

*Attesting Officer*

*Commissioner of Patents and Trademarks*